US008341862B1

(12) United States Patent
Gunther

(10) Patent No.: US 8,341,862 B1
(45) Date of Patent: Jan. 1, 2013

(54) GREETING CARD DISPLAY SYSTEMS

(76) Inventor: Julie Gunther, Tucson, AZ (US)

( * ) Notice: Subject to any disclaimer, the term of this patent is extended or adjusted under 35 U.S.C. 154(b) by 155 days.

(21) Appl. No.: 12/711,552

(22) Filed: Feb. 24, 2010

Related U.S. Application Data

(60) Provisional application No. 61/156,415, filed on Feb. 27, 2009.

(51) Int. Cl.

| | |
|---|---|
| ***G09F 3/18*** | (2006.01) |
| ***G09F 3/10*** | (2006.01) |
| ***G09F 1/00*** | (2006.01) |
| ***A47G 1/06*** | (2006.01) |
| ***G09D 3/02*** | (2006.01) |

(52) U.S. Cl. ..... 40/661; 40/701; 40/702; 40/703; 40/773; 40/722; 40/774; 40/673; 40/672; 40/122; 40/776; 40/594; 40/124.06; 206/449; 206/308.1; 229/72; 229/67.1; 229/67.4

(58) Field of Classification Search ..... 40/701–703, 40/773, 722, 774, 661, 673, 672, 122, 776, 40/594, 124.06; 206/459, 308.1; 229/72, 229/67.1, 67.4

See application file for complete search history.

(56) References Cited

U.S. PATENT DOCUMENTS

| | | | | |
|---|---|---|---|---|
| 253,356 | A * | 2/1882 | Edmondson | 229/72 |
| 2,718,911 | A * | 9/1955 | Solomon | 150/147 |
| 2,925,675 | A * | 2/1960 | Lumpkin | 40/643 |
| 3,696,532 | A * | 10/1972 | Nahon | 40/661 |
| 4,620,630 | A * | 11/1986 | Moss | 206/45.24 |
| 5,873,513 | A * | 2/1999 | Ong | 229/67.1 |
| 6,390,714 | B1 * | 5/2002 | Bradley et al. | 402/79 |
| 7,418,796 | B2 * | 9/2008 | Anastasio | 40/735 |
| 2005/0198882 | A1 * | 9/2005 | Zaremba | 40/654.01 |
| 2006/0162213 | A1 * | 7/2006 | Einarson | 40/765 |
| 2008/0115396 | A1 * | 5/2008 | Gamboa | 40/661 |

* cited by examiner

*Primary Examiner* — Tashiana Adams
*Assistant Examiner* — Syed A Islam

(57) ABSTRACT

A greeting card display system featuring a sleeve, wherein at least the bottom edge is sealed and either the first or second side edge is sealed; a slot disposed in the top edge adapted to accommodate insertion of a greeting card between the front and back surface; an inside crease disposed in the front surface of the sleeve, the inside crease divides the front surface into a first inside surface and a second inside surface, the sleeve can move between an open position wherein first inside surface does not contact the second inside surface and a closed position wherein the first inside surface contacts the second inside surface; and a spine crease disposed in the back surface of the sleeve formed by moving the sleeve from the open position to the closed position, the spine crease divides the back surface into a first outside surface and a second outside surface.

14 Claims, 9 Drawing Sheets

GREETING CARD DISPLAY SYSTEMS

CROSS REFERENCE

This application claims priority to U.S. provisional application Ser. No. 61/156,415 filed Feb. 27, 2009, the specifications of which is incorporated herein by reference in its entirety.

FIELD OF THE INVENTION

The present invention is directed to display devices, more particularly to a display system for displaying greeting cards in various ways.

BACKGROUND OF THE INVENTION

Many individuals save greeting cards. Some prop them up on tables, desks, or mantles, whereas other individuals may store them in boxes or photo albums.

The present invention features a novel greeting card display system for displaying greeting cards. The system of the present invention provides an aesthetically pleasing means of displaying greeting cards, whether on a frame (e.g., hanging frame, prop-up frame), or in books and albums.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a greeting card display system. In some embodiments, the system comprises a sleeve having a front surface, a back surface, a first side edge, a second side edge opposite the first side edge, a bottom edge, and a top edge, wherein at least the bottom edge is sealed and either the first side edge or second side edge is sealed; a slot disposed in the top edge adapted to accommodate insertion of a greeting card into the sleeve between the front surface and the back surface; an inside crease disposed in the front surface of the sleeve extending from the top edge to the bottom edge, the inside crease divides the front surface into a first inside surface and a second inside surface, the sleeve can move between an open position wherein first inside surface does not contact the second inside surface and a closed position wherein the first inside surface contacts the second inside surface; and a spine crease disposed in the back surface of the sleeve formed by moving the sleeve from the open position to the closed position, the spine crease divides the back surface into a first outside surface and a second outside surface.

In some embodiments, the sleeve is translucent, transparent, semi-translucent, semi-transparent, opaque, semi-opaque, or a combination thereof. In some embodiments, the sleeve is constructed from a material comprising plastic (e.g., vinyl or a derivative thereof). In some embodiments, the sleeve is constructed in a shape of a rectangle, a circle, a heart, a star, a triangle, a hexagon, an octagon, or a combination thereof. In some embodiments, the sleeve is between about 3 to 12 inches in width as measured from the first side edge to the second side edge (or more than about 12 inches in width). In some embodiments, the sleeve is between about 3 to 8 inches in height as measured from the top edge to the bottom edge (or more than about 8 inches in height as measured from the top edge to the bottom edge).

In some embodiments, the bottom edge, the first side edge, and the second side edge are each sealed. In some embodiments, the first inside surface and the second inside surface are symmetrical or asymmetrical. In some embodiments, the greeting card display system further comprises a securing means functioning to secure the sleeve in the closed position. The securing means may comprise, for example, an adhesive component, a hook-and-loop fastener system, a magnet system, a snap system, a hook system, a string system, a button system, or a combination thereof. In some embodiments, the securing means is disposed on the first inside surface, the second inside surface, the first outside surface, the second outside surface, both the first inside surface and second inside surface, or both the first outside surface and the second outside surface. In some embodiments, the securing means is disposed on the first inside surface near the first side edge or the second inside surface near the second side edge. In some embodiments, the securing means is disposed on the first outside surface near the first side edge or the second outside surface near the second side edge.

In some embodiments, the greeting card display system further comprises at least one first attachment means for attaching the sleeve to a frame, a book, or a wall. The first attachment means may comprise, for example, an adhesive component, a hook-and-loop fastener system, a magnet system, a snap system, a hook system, a string system, a button system, or a combination thereof. In some embodiments, the first attachment means is disposed on the first outside surface or the second outside surface. In some embodiments, the greeting card display system further comprises a tab with aperture disposed on the spine crease, the tab with aperture functions to allow the sleeve to be secured with a binder.

In some embodiments, the greeting card display system further comprises at least one decorative component disposed on the sleeve. The decorative component may comprise one or more of the following: a bead, a silk flower, a dried flower, a magnet, a piece of glass, a stone, a piece of foam, a photograph, a transparency, a piece of string, a piece of yarn, a piece of ribbon, a piece of wrapping paper, a piece of wood, a piece of metal, a piece of fabric, a piece of plastic, a gold leaf, a fabric leaf, a semi-precious stone, a gold foil, a silver foil, a copper foil, an ink stamp, a paper stamp, a marker ink, a paint, a glass paint, an acrylic paint, a gel, a wire, a sticker, a crayon drawing, raffia, a mechanical decorative member, or combinations thereof.

In some embodiments, the greeting card display system further comprises a handle piece for providing a means of easily moving the sleeve from the closed position to the open position. In some embodiments, the handle component is disposed on the first outside surface or the second outside surface of the sleeve. In some embodiments, the handle component is disposed on the first outside surface near the first side edge.

The present invention also features a kit comprising a greeting card display system, for example as described above. The kit may further comprise a frame, wherein the greeting card display system can be attached to the frame via the first attachment means. In some embodiments, the kit further comprises a binder, wherein the greeting card display system can be attached a ring of the binder via the tab with aperture.

In some embodiments, the first attachment means comprises an adhesive component, a hook-and-loop fastener system, a magnet system, a snap system, a hook system, a string system, a button system, or a combination thereof. In some embodiments, the kit further comprises at least one decorative component for attaching to the sleeve, the frame, or a combination thereof. The decorative component may comprise one or more of the following: a bead, a silk flower, a dried flower, a magnet, a piece of glass, a stone, a piece of foam, a photograph, a transparency, a piece of string, a piece of yarn, a piece of ribbon, a piece of wood, a piece of wrapping paper, a piece of metal, a piece of fabric, a piece of plastic, a gold leaf, a fabric leaf, a semi-precious stone, a gold foil, a silver foil, a copper foil, an ink stamp, a paper stamp, a marker ink, a paint, a glass paint, an acrylic paint, a gel, a wire, a sticker, a crayon drawing, raffia, a mechanical decorative member, or combinations thereof.

In some embodiments, the kit further comprises a frame slot disposed in the frame, wherein the frame slot is adapted to receive the greeting card display system. In some embodiments, the kit further comprises a wall mount hook disposed on a back surface of the frame, the wall mount hook functions to allow the frame to be mounted on a wall. In some embodiments, the frame is constructed from a material comprising poster board, foam board, cardboard, or a combination thereof. In some embodiments, the frame slot is a die cut center.

The present invention also features a method displaying a greeting card. In some embodiments, the method comprises providing a greeting card display system, for example as described above, providing a frame, wherein the greeting card display system can be attached to the frame via the first attachment means; inserting a greeting card into the sleeve between the front surface and the back surface via the slot in the top edge; and attaching the second outside surface to the frame via the first attachment means.

In some embodiments, the method further comprises decorating the greeting card display system or the frame with at least one decorative component, for example as described above. In some embodiments, the frame further comprises a frame slot adapted to receive the greeting card display system. In some embodiments, the greeting card display system is attached to the frame slot of the frame via the first attachment means. In some embodiments, the method further comprises cutting a frame slot in the frame, the frame slot being adapted to receive the greeting card display system.

In some embodiments, the greeting card display system is attached to the frame slot of the frame via the first attachment means. In some embodiments, the method further comprises attaching a wall mount hook to a back surface of the frame. In some embodiments, the method further comprises mounting the frame on a wall via the wall mount hook. In some embodiments, the frame is constructed from a material comprising poster board, foam board, cardboard, or a combination thereof. In some embodiments, the frame slot is a die cut center.

DESCRIPTION OF PREFERRED EMBODIMENTS

Referring now to FIGS. 1-7, the present invention features a novel greeting card display system 100 for displaying greeting cards. The system of the present invention provides an aesthetically pleasing means of displaying greeting cards, whether on a frame (e.g., hanging frame, prop-up frame), or in books and albums.

Figure 1:
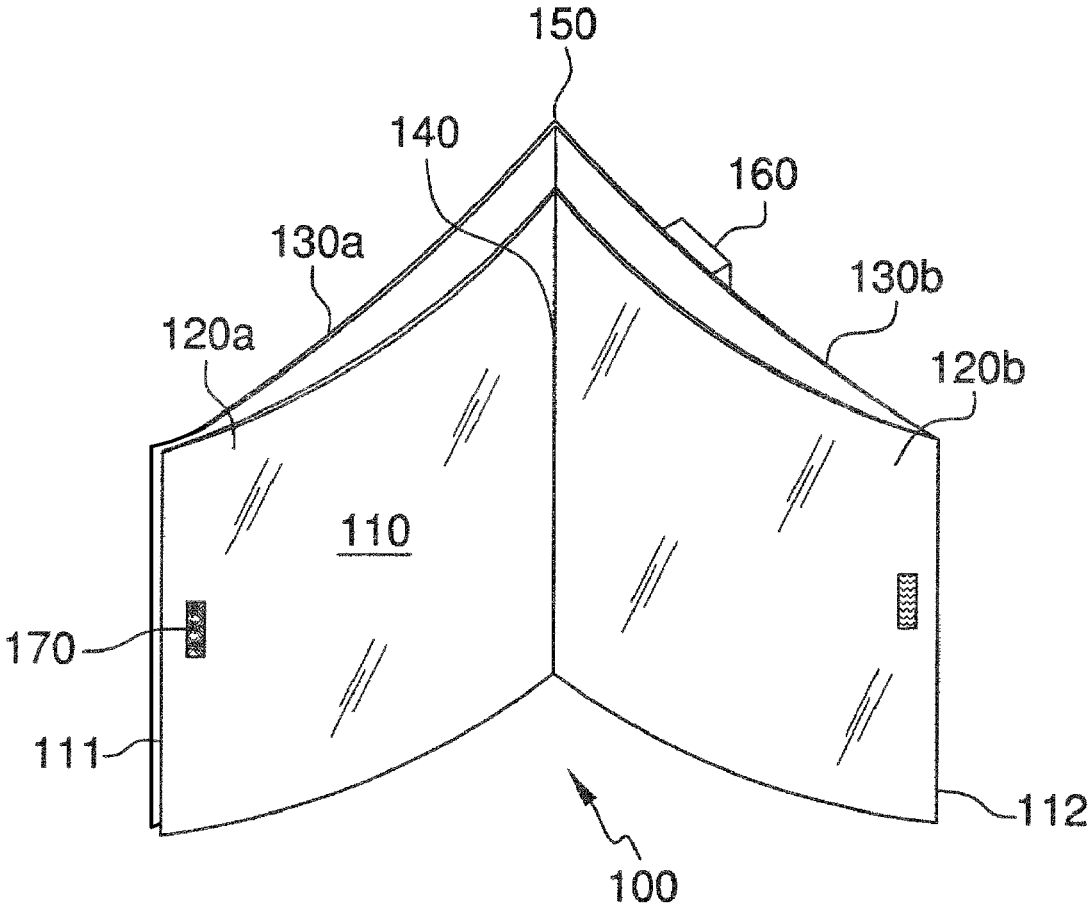
FIG. 1 is a perspective view of a greeting card display system of the present invention.

Referring now to FIG. 1, the greeting card display system may comprise a sleeve 110 for holding the greeting card. The sleeve 110 has a front surface, a back surface, a first side edge 111, a second side edge 112 opposite the first side edge 111, a bottom edge, and a top edge. In some embodiments, the bottom edge and the first side edge 111 is sealed or partially sealed (e.g., leaving the top edge and second side edge 112 open or partially open). In some embodiments, the bottom edge, the first side edge 111, and the second side edge 112 are sealed or partially sealed (e.g., leaving the top edge open or partially open).

A slot is disposed in the top edge of the sleeve 110. The slot is adapted to accommodate the insertion of a greeting card into the sleeve 110. The greeting card 101 is slid between the front surface and the back surface of the sleeve 110. In some embodiments, the inside surfaces of the greeting card first panel 102 and the greeting card second panel 103 face the front surface of the sleeve 110 and the outer surfaces of the greeting card first panel 102 and the greeting card second panel 103 face the back surface of the sleeve 110. The greeting card first panel 102 has a first panel first edge 104 and a first panel second edge 105. The greeting card second panel 103 has a second panel first edge 106 and a second panel second edge 107. The greeting card panels are connected at a fold at the first panel first edge 104 and the second panel second edge 107.

An inside crease 140 is disposed in the front surface of the sleeve 110 extending from the top edge to the bottom edge of the sleeve 110. The inside crease 140 divides the front surface into a first inside surface 120*a* and a second inside surface 120*b*. The sleeve 110 can move between an open position wherein first inside surface 120*a* does not contact the second inside surface 120*b* and a closed position wherein the first inside surface 120*a* contacts the second inside surface 120*b*. This movement between the open position and closed position is similar to the opening and closing of the greeting card itself.

A spine crease 150 is disposed in the back surface of the sleeve 110, for example opposite the inside crease 140. The spine crease 150 is formed by moving the sleeve 110 from the open position to the closed position (e.g., opening the greeting card and closing the greeting card). The spine crease 150 divides the back surface into a first outside surface 130*a* and a second outside surface 130*b*. As shown in FIG. 1, the first outside surface 130*a* is opposite the first inside surface 120*a*, and the second outside surface 130*b* is opposite the second inside surface 120*b*.

The sleeve 110 may be constructed from a variety of materials. For example, the sleeve 110 may be constructed from a material comprising a plastic (e.g., a vinyl or derivative thereof). In some embodiments, the sleeve 110 is constructed from a material comprising plastic (e.g., vinyl or a derivative thereof), a metal (e.g., aluminum), a cloth or fabric, a rubber, a foam, the like, or a combination thereof. For example, various materials may be used for decorating the sleeve 110, for reinforcing the spine crease 150 and/or inside crease 140, for softening sharp edges of the sleeve 110, etc. The present invention is not limited to the aforementioned materials. In some embodiments, the sleeve 110 is translucent, transparent, semi-translucent, semi-transparent, opaque, or a combination thereof. In some embodiments, the sleeve 110 has color such as red, yellow, green, blue, orange, purple, black, brown, white, the like, or combinations thereof. In some embodiments, the sleeve 110 can be made shiny with stardust, glitter, glitter glue, gold leafing, gold and silver flecks, or combinations thereof.

The sleeve 110 may be constructed in a variety of shape and sizes. For example, in some embodiments, the sleeve 110 is constructed in a shape of a rectangle, a circle, a heart, a star, a triangle, a hexagon, an octagon, other geometrical or irregular shapes, or a combination thereof. In some embodiments, the first inside surface 120*a* and the second inside surface 120*b* are symmetrical. In some embodiments, the first inside surface 120*a* and the second inside surface 120*b* are asymmetrical.

In some embodiments, the sleeve 110 is between about 3 to 6 inches in width as measured from the first side edge 111 to the second side edge 112. In some embodiments, the sleeve 110 is between about 6 to 12 inches in width as measured from the first side edge 111 to the second side edge 112. In some embodiments, the sleeve 110 is more than about 12 inches in width as measured from the first side edge 111 to the second side edge 112. In some embodiments, the sleeve 110 is between about 3 to 8 inches in height as measured from the top edge to the bottom edge. In some embodiments, the sleeve 110 is more than about 8 inches in height as measured from the top edge to the bottom edge.

Figure 6:
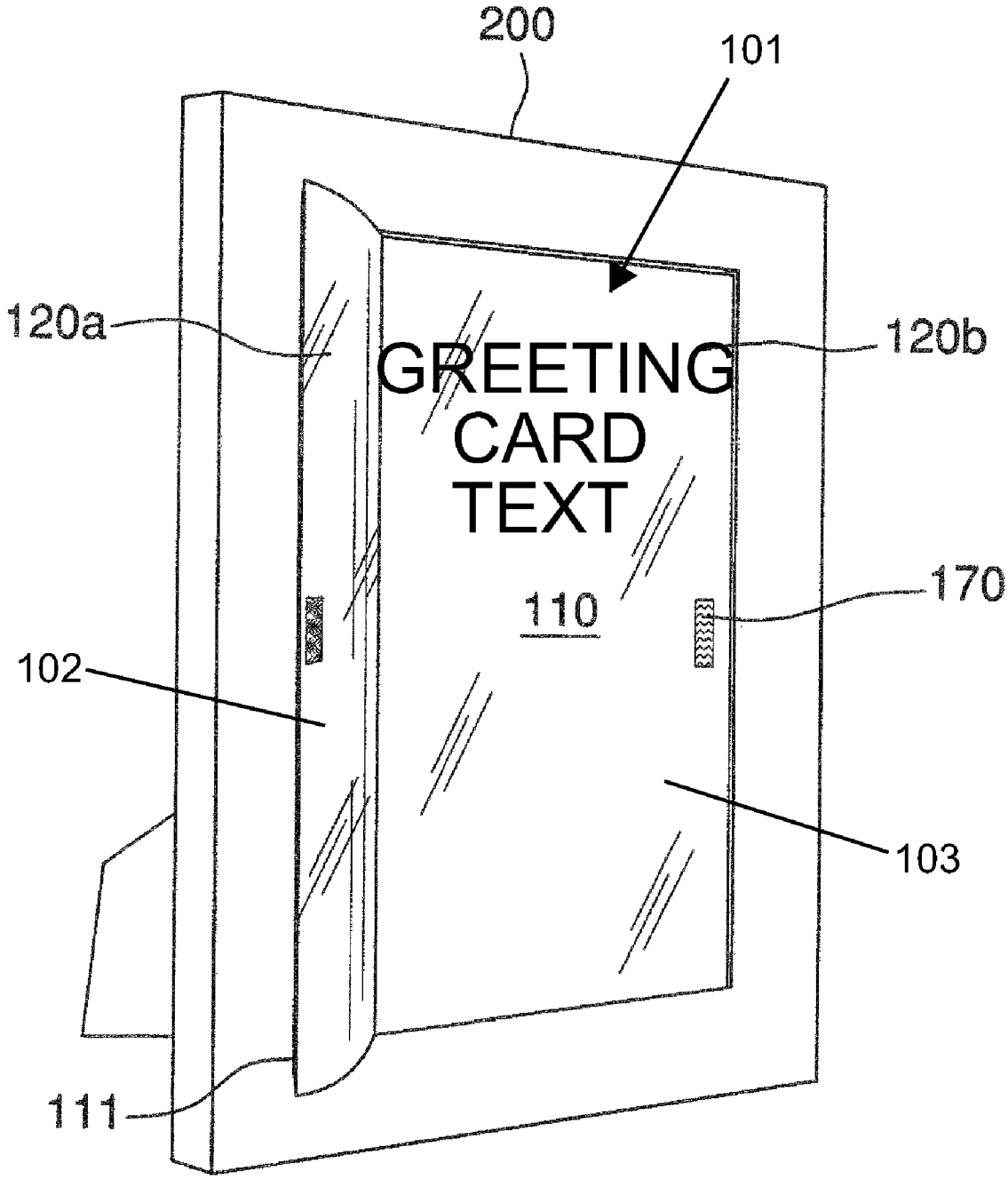
FIG. 6 is a perspective view of a sleeve attached to a frame, wherein the sleeve is in the open position.
Figure 7:
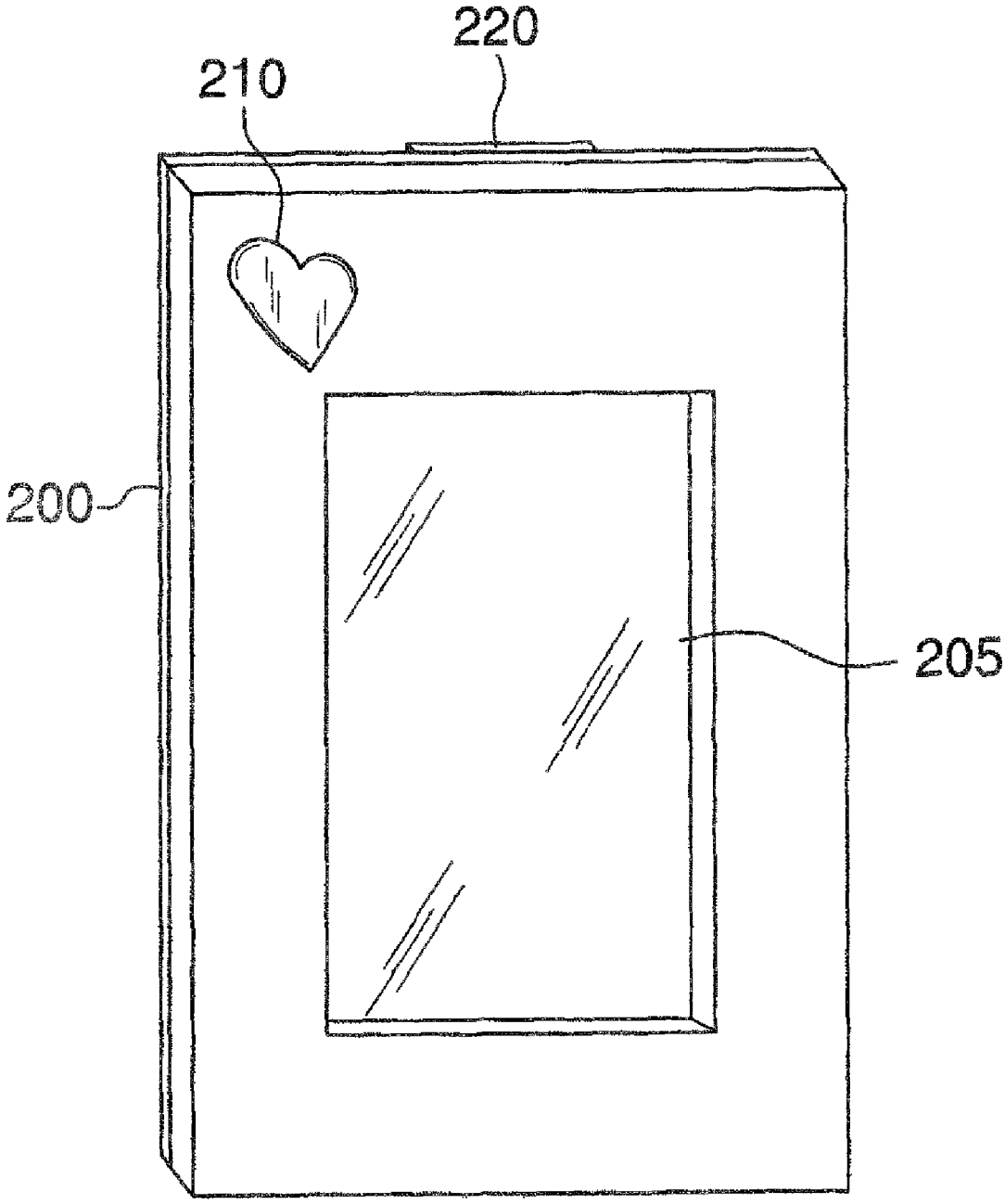
FIG. 7 is a front view of a frame decorated with a decorative component.

Referring now to FIG. 1 and FIG. 6, the system 110 of the present invention further comprises a securing means 170 functioning to secure the sleeve 110 in the closed position. The securing means 170 may be one or a combination of various standard securing means. For example, in some embodiments, the securing means 170 comprises an adhesive component, a hook-and-loop fastener system, a magnet system, a snap system, a hook system, a string system, a button system, the like, or a combination thereof.

The securing means 170 show in FIG. 1 and FIG. 6 is disposed on both the first inside surface 120*a* (e.g., near the first side edge 111) and second inside surface 120*b* (e.g., near the second side edge 112). However, in some embodiments, the securing means 170 is disposed on the first inside surface 120*a* in other positions such as near the top edge or bottom edge, the second inside surface 120*b* in other positions such as near the top edge or bottom edge, the first outside surface 130*a* in various positions (e.g., near the second side edge 112, near the top edge or bottom edge, etc.), and/or the second outside surface 130*b* in various positions (e.g., near the second side edge 112, near the top edge or bottom edge, etc.). In some embodiments, the securing means 170 is disposed on just the first inside surface 120*a*, just the second inside surface 120*b*, both the first inside surface 120*a* and the second inside surface 120*b*, just the first outside surface 130*a*, just the second outside surface 130*b*, both the first outside surface 130*a* and the second outside 130*b*, or various combinations thereof.

Figure 2:
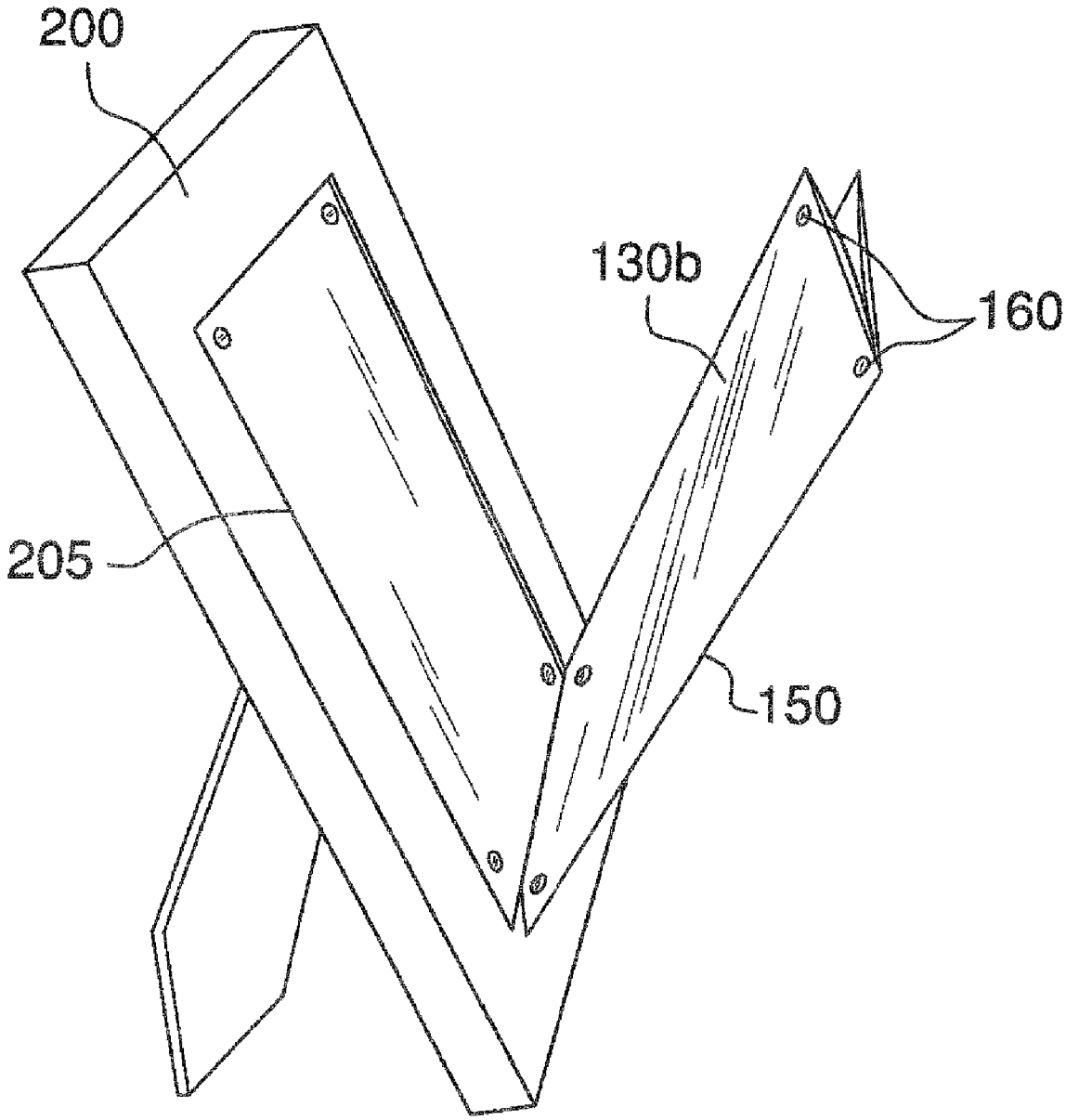
FIG. 2 is a perspective view of a greeting card display system, wherein a sleeve is attached to a frame via a first attachment means.
Figure 3:
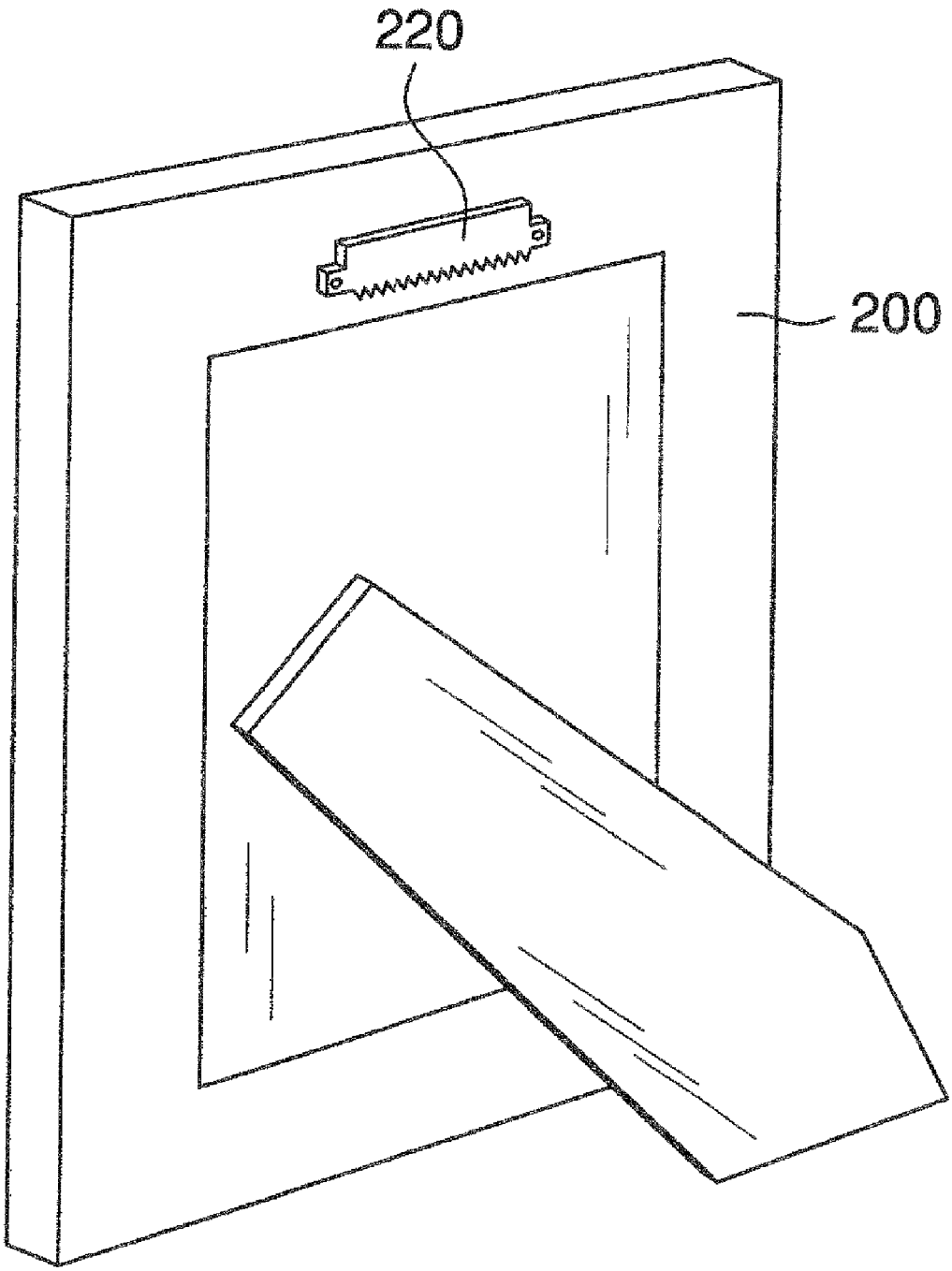
FIG. 3 is a back view of a frame.

Referring now to FIG. 1 and FIG. 2, the greeting card display system may further comprise one or more first attachment means 160 for attaching the sleeve 110 to a frame 200, a book, a wall, or the like. In some embodiments, the first attachment 160 means comprises an adhesive component, a hook-and-loop fastener system, a magnet system, a snap system, a hook system, a string system, a button system, the like, or a combination thereof. The present invention is not limited to the aforementioned examples of first attachment means.

As shown in FIG. 1 and FIG. 2, the first attachment means 160 may be disposed on the second outside surface 130*b*. In some embodiments, the first attachment means 160 is disposed on the first outside surface 130*a*, the first inside surface 120*a*, the second inside surface 120*b*, the second outside surface 130*b*, or a combination thereof.

Figure 1A:
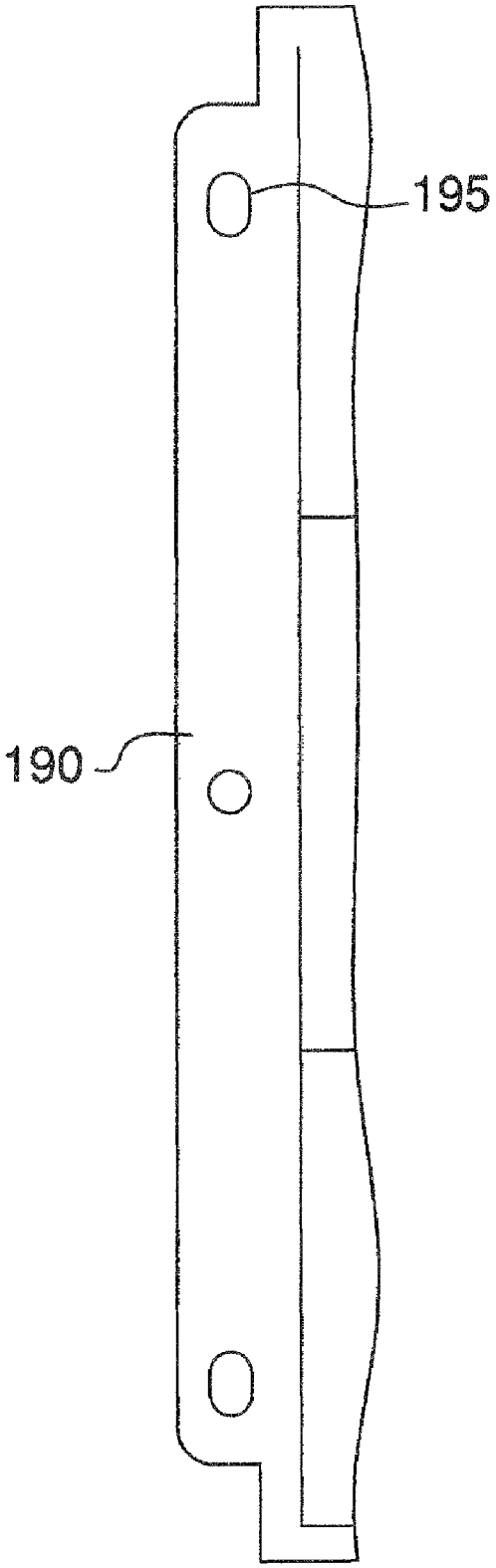
FIG. 1A and FIG. 1B are top views of examples of tabs for inserting the sleeve into a book or binder.
Figure 1B:
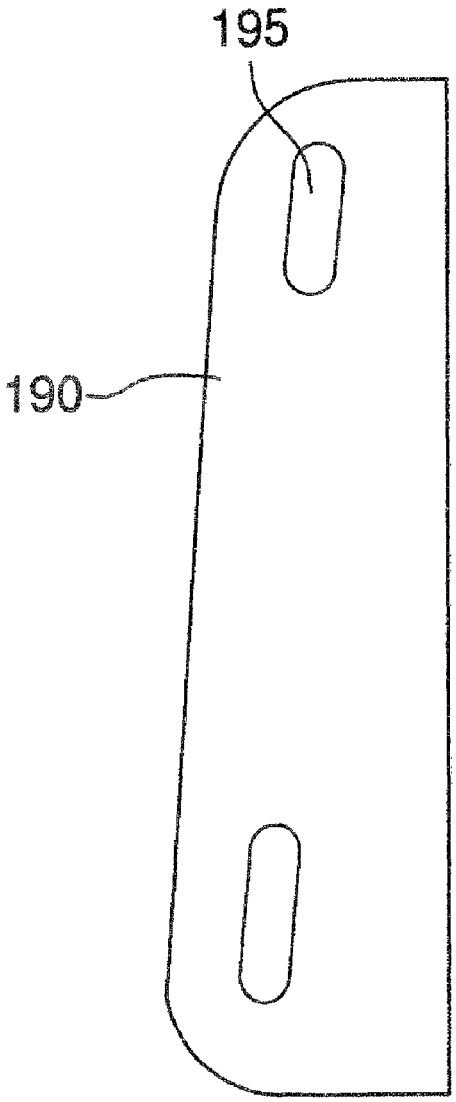

Referring now to FIG. 1A and FIG. 1B, in some embodiments, the greeting card display system of claim 1 further comprising a tab 190 functioning to allow the sleeve 110 to be secured in a book or a binder. Tab 190 may comprise none, one or more apertures 195 adapted to receive the rings of a binder. FIG. 1A shows an example of a tab 190 with three apertures 195, and FIG. 1B shows an example of a tab 190 with two apertures 195. Such tabs 190 are well known to one of ordinary skill in the art. In some embodiments, the tab 190 is disposed on the spine crease 150. In some embodiments, the tab 190 is disposed on the second outside surface 130*b* or other location.

Figure 1C:
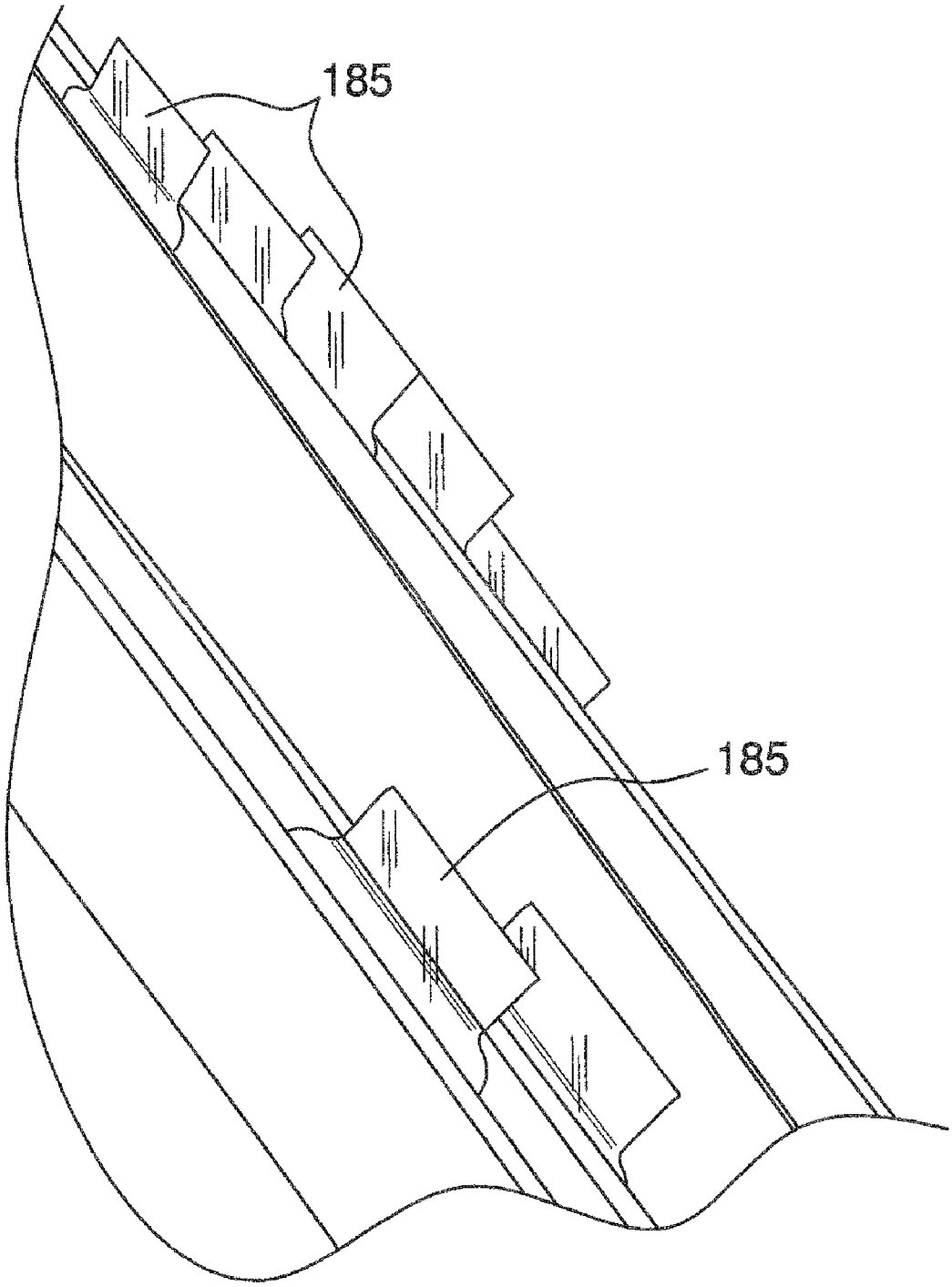
FIG. 1C is a perspective view of examples of indicator tabs for organizing sleeves.

As shown in FIG. 1C, in some embodiments, the greeting card display system of claim 1 further comprising an indicator tab 185 for indicating what card is displayed. The indicator tab 185 can be labeled. Such indicator tabs are well known to one of ordinary skill in the art. The indicator tabs 185 may be useful, for example, if greeting cards are displayed in a book or binder. A use can use the indicator tabs 185 to locate a card of choice. In some embodiments, the indicator tab 185 is disposed on the first side edge 111 or the second side edge 112 of the sleeve 110. The present invention is not limited to this configuration. For example, in some embodiments, the indicator tab 185 is disposed on the top edge and/or the bottom edge, or a combination thereof.

Figure 4:
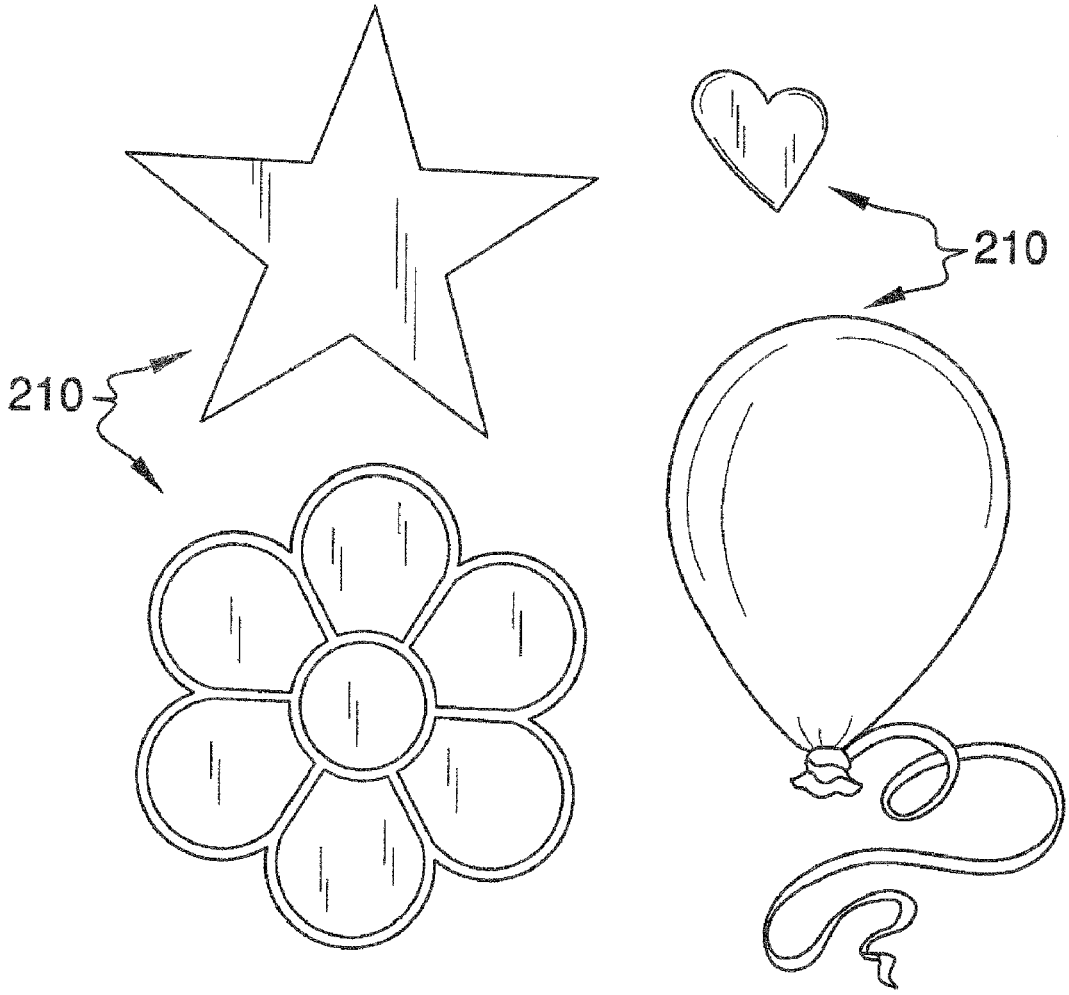
FIG. 4 is a front view of a plurality of decorative components.
Figure 5:
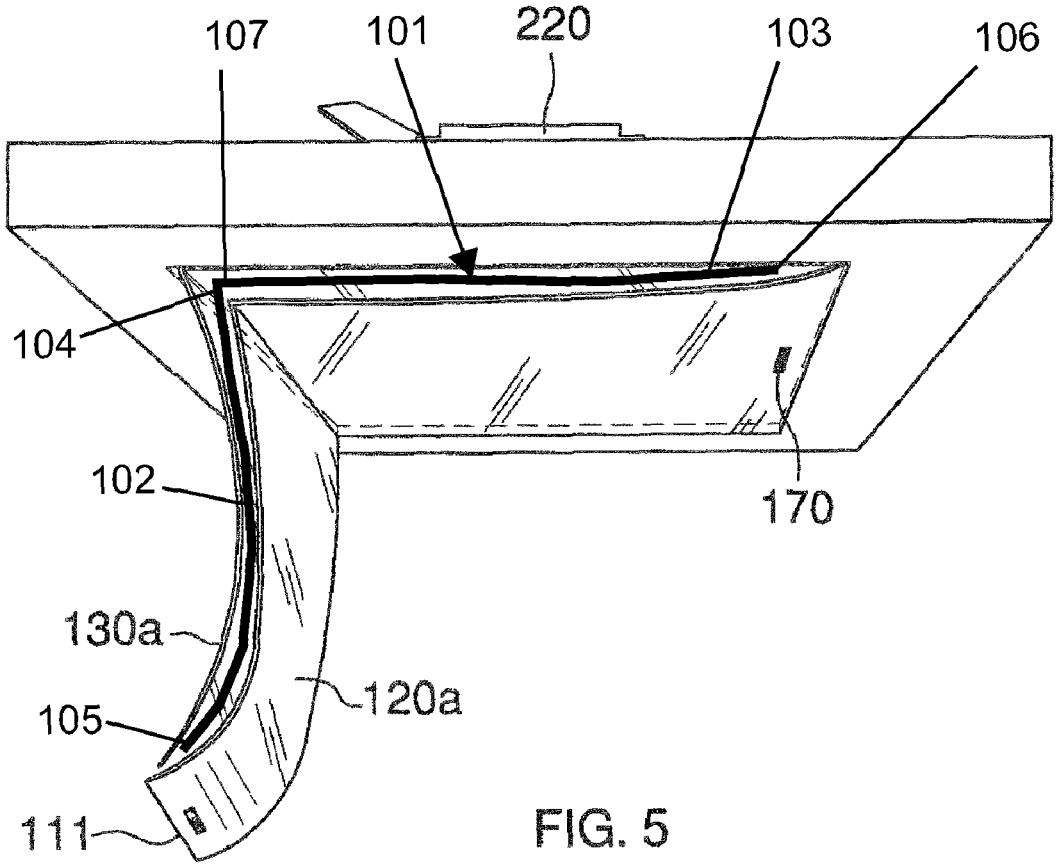
FIG. 5 is a top view of a sleeve attached to a frame, wherein the sleeve is in the open position.

Referring now to FIG. 4 and FIG. 4, the greeting card display system may further comprise at least one decorative component 210 disposed on the sleeve 110 or for attaching to the sleeve 110 (e.g., anywhere on the sleeve 110) or on another item such as a frame 200, book, or binder. Decorative components 210 may include but are not limited to: a bead, a silk flower, a dried flower, a magnet, a piece of glass, a stone, a piece of foam, a photograph, a transparency, a piece of string, a piece of wood, a piece of yarn, a piece of ribbon, a piece of wrapping paper, a piece of metal, a piece of fabric, a piece of plastic, a gold leaf, a fabric leaf, a semi-precious stone, a gold foil, a silver foil, a copper foil, an ink stamp, a paper stamp, a marker ink, a paint, a glass paint, an acrylic paint, a gel, a wire, a sticker, a crayon drawing, raffia, a mechanical decorative member, the like or combinations thereof.

In some embodiments, a handle piece is disposed on the sleeve 110. The handle piece may help provide a means of easily moving the sleeve from the closed position to the open position. In some embodiments, the handle component is disposed on the first outside surface 130*a* and/or the second outside surface 130*b* of the sleeve 110 (e.g., near the first side edge 111 and/or the second side edge 112). The handle is not limited to this configuration.

KITS

The present invention also features a kit comprising one or more greeting card display systems 100 as described. For example, in some embodiments, the sleeve 110 may comprise a first attachment means 160 (e.g., an adhesive component, a hook-and-loop fastener system, a magnet system, a snap system, a hook system, a string system, a button system, the like, or a combination thereof) disposed on the first outside surface 130*a* or the second outside surface 130*b*. Or, the sleeve 110 may comprise a tab 190 with apertures 195 and/or indicator tabs 185 (e.g., a tab 190 disposed on the spine crease 150).

The kit may further comprise a frame 200, a book, a binder (e.g., a ring binder), the like, or a combination thereof. Examples of frames 200 are shown in FIG. 2, FIG. 3, FIG. 5, FIG. 6, and FIG. 7. In some embodiments, the frame 200 comprises a frame slot 205 adapted to receive the greeting card display system 100 (e.g., sleeve 110). The greeting card display system 100 (e.g., the sleeve 110) can be attached to the frame 200 via the first attachment means 160. FIG. 2 shows an example of a sleeve 110 with first attachment means 160 disposed on the second outside surface 130*b* being mated with attachment means disposed on the frame 200, for example in the frame slot 205.

The frame 200 may be propped up (e.g., see FIG. 2). In some embodiments, the frame 200 can be hung on a wall or other surface via a wall mounting means. A mounting means (e.g., a wall mount hook 220) is shown disposed on the frame 200 in FIG. 3. In some embodiments the kit comprises the mounting means (e.g., wall mount hook 220), and the user can attach it to the frame 200 if desired.

The kit may comprise one or more decorative components 210 (e.g., a bead, a silk flower, a dried flower, a magnet, a piece of glass, a stone, a piece of foam, a photograph, a transparency, a piece of string, a piece of yarn, a piece of ribbon, a piece of wood, a piece of wrapping paper, a piece of metal, a piece of fabric, a piece of plastic, a gold leaf, a fabric leaf, a semi-precious stone, a gold foil, a silver foil, a copper foil, an ink stamp, a paper stamp, a marker ink, a paint, a glass paint, an acrylic paint, a gel, a wire, a sticker, a crayon drawing, raffia, a mechanical decorative member, the like, or combinations thereof) for attaching to the sleeve, the frame (or book or binder), or a combination thereof.

In some embodiments, the kit comprises components for a user to construct the frame 200. In some embodiments, the frame 200 is constructed from a material comprising poster board, foam board, cardboard, the like, or a combination thereof. In some embodiments, the frame slot 205 is a die cut center.

Methods of Displaying Greeting Cards

The present invention also features methods of displaying a greeting card. In some embodiments, the method comprises providing a greeting card display system 100 of the present invention, for example as described above and inserting a greeting card into the sleeve between the front surface and the back surface (e.g., via the slot in the top edge).

The method may further comprise providing a frame, wherein the greeting card display system 100 (e.g., sleeve 110) can be attached to the frame 200 (or frame slot 205) via the first attachment means 160. For example, the second outside surface 130*b* may be attached to the frame 200 (or frame slot 205) via the first attachment means 160. In some embodiments, the method comprises assembling the frame 200 and/or cutting a frame slot 205 (e.g., die cut center) in the frame 200.

The method may further comprise providing a binder or a book, wherein the greeting card display system 100 (e.g., sleeve 110) can be attached to the book or binder via the tab 190 (e.g., with apertures 195).

The method may further comprise decorating the greeting card display system 100 or the frame 200 (or book or binder) with at least one decorative component 210 (e.g., a bead, a silk flower, a dried flower, a magnet, a piece of glass, a stone, a piece of foam, a photograph, a transparency, a piece of string, a piece of yarn, a piece of ribbon, a piece of wrapping paper, a piece of metal, a piece of fabric, a piece of plastic, a gold leaf, a fabric leaf, a semi-precious stone, a gold foil, a silver foil, a copper foil, an ink stamp, a paper stamp, a marker ink, a paint, a glass paint, an acrylic paint, a gel, a wire, a sticker, a crayon drawing, raffia, a mechanical decorative member, a glow-in-the-dark component, the like, or combinations thereof.)

In some embodiments, the method further comprises attaching a wall mount hook to a back surface of the frame. In some embodiments, the method further comprises mounting the frame on a wall via the wall mount hook.

In some embodiments the decorative components 210 are attached to the sleeve 110, the frame 200, the book, the binder, the greeting card, or a combination thereof via a second attachment means (e.g., a tool). In some embodiments, the second attachment means (e.g., a tool) is a gluing solution, a staple mechanism, an adhesive mechanism, a button mechanism, a string mechanism, a clip mechanism, the like, or a combination thereof. In some embodiments, the gluing solution is a temporary glue, allowing a user to remove the decorative component 210 if desired. Or, the gluing solution may be a permanent glue. In some embodiments, the gluing solution comprises a tacky glue, a glitter glue, a white glue, a yellow glue, a fabric glue, a wallpaper paste, a polyurethane glue, a water-based glue, a gloss-based sealer, a surfactant, derivatives thereof, water, or combinations thereof. The present invention is not limited to the aforementioned examples of gluing solutions.

As used herein, the term "about" refers to plus or minus 10% of the referenced number. For example, an embodiment wherein the sleeve is about 10 inches in width includes a sleeve 110 that is between 9 and 11 inches in width.

For any embodiment of the present invention, the term "transparent" is interchangeable with the term translucent, semi-translucent, semi-transparent, semi-opaque, or combinations thereof. For example, an embodiment wherein the sleeve 110 is transparent includes a sleeve 110 that is semi-opaque.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A greeting card display system comprising:

(a) a single sleeve having a front surface, a back surface, a first side edge, a second side edge opposite the first side edge, a bottom edge, and a top edge, wherein only the bottom edge and either the first side edge or second side edge is sealed;

(b) a slot disposed in the top edge adapted to accommodate insertion of a greeting card into the single sleeve between the front surface and the back surface;

(c) an inside crease disposed in the front surface of the single sleeve extending from the top edge to the bottom edge, the inside crease divides the front surface into a first inside surface and a second inside surface, the first inside surface and the second inside surface are symmetrical, a cavity formed by the sealed bottom edge and either the sealed first side edge or the second side edge is not divided into two cavities by the inside crease, rather the cavity remains singular, the single sleeve can move between an open position wherein first inside surface does not contact the second inside surface and a closed position wherein the first inside surface contacts the second inside surface;

(d) a spine crease disposed in the back surface of the single sleeve formed by moving the single sleeve from the open position to the closed position, the spine crease divides the back surface into a first outside surface and a second outside surface;

(e) a greeting card having only a card first panel and an equally sized card second panel at a fold, wherein the card first panel comprises a card first panel first edge, and a card first panel second edge, wherein the card second panel comprises a card second panel first edge, and a card second panel second edge, wherein a card first panel first edge is pivotally joined to a card second panel second edge, wherein for use, the greeting card is inserted into the single sleeve via the open top edge and either the open first side edge or the open second side edge, wherein the greeting card fold is disposed at the inside crease and the spine crease of the single sleeve; and (f) a frame having an open frame slot disposed therein on a front surface of a frame, wherein the frame slot is adapted to receive the single sleeve, wherein for use, the single sleeve is disposed in the frame slot and attached thereto via a first attachment means disposed on a second outside surface of the single sleeve, wherein the single sleeve is inset into the frame slot and does not project beyond the frame front surface, wherein a first outside surface of the single sleeve faces outward and is not covered by a protective covering in or on the frame, wherein when the single sleeve is disposed in the frame, the single sleeve can be moved from the closed position to the open position for viewing the greeting card, then returned to the closed position.

2. The greeting card display system of claim 1 further comprising a securing means functioning to secure the sleeve in the closed position.

3. The greeting card display system of claim 2, wherein the securing means comprises an adhesive component, a hook-and-loop fastener system, a magnet system, a snap system, a hook system, a string system, a button system, or a combination thereof.

4. The greeting card display system of claim 1, wherein the first attachment means comprises an adhesive component, a hook-and-loop fastener system, a magnet system, a snap system, a hook system, a string system, a button system, or a combination thereof.

5. The greeting card display system of claim 1 further comprising a tab with aperture disposed on the spine crease, the tab with aperture functions to allow the sleeve to be secured with a binder.

6. The greeting card display system of claim 1 further comprising at least one decorative component disposed on the sleeve.

7. The greeting card display system of claim 1 further comprising a handle piece for providing a means of easily moving the sleeve from the closed position to the open position.

8. A kit comprising:

(a) a greeting card display system comprising:

(i) a single sleeve having a front surface, a back surface, a first side edge, a second side edge opposite the first side edge, a bottom edge, and a top edge, wherein at least the bottom edge is sealed and either the first side edge or second side edge is sealed;

(ii) a slot disposed in the top edge adapted to accommodate insertion of a greeting card into the single sleeve between the front surface and the back surface;

(iii) an inside crease disposed in the front surface of the single sleeve extending from the top edge to the bottom edge, the inside crease divides the front surface into a first inside surface and a second inside surface, the first inside surface and the second inside surface are symmetrical, a cavity formed by the sealed bottom edge and either the sealed first side edge or the second side edge is not divided into two cavities by the inside crease, rather the cavity remains singular, the single sleeve can move between an open position wherein first inside surface does not contact the second inside surface and a closed position wherein the first inside surface contacts the second inside surface;

(iv) a spine crease disposed in the back surface of the single sleeve formed by moving the single sleeve from the open position to the closed position, the spine crease divides the back surface into a first outside surface and a second outside surface; and (v) a first attachment means disposed on the first outside surface or the second outside surface; and (b) a frame, wherein the greeting card display system can be attached to the frame via the first attachment means.

9. The kit of claim 8 further comprising a securing means functioning to secure the sleeve in the closed position.

10. The kit of claim 8, wherein the first attachment means comprises an adhesive component, a hook-and-loop fastener system, a magnet system, a snap system, a hook system, a string system, a button system, or a combination thereof.

11. The kit of claim 8 further comprising at least one decorative component for attaching to the sleeve, the frame, or a combination thereof.

12. The kit of claim 8 further comprising a handle piece for providing a means of easily moving the sleeve from the closed position to the open position.

13. The kit of claim 8 further comprising a wall mount hook disposed on a back surface of the frame, the wall mount hook functions to allow the frame to be mounted on a wall.

14. The kit of claim 8, wherein the frame is replaced with a binder, wherein the greeting card display system can be attached to a ring of the binder via a tab with aperture.

* * * * *